United States Patent [19]

Cates

[11] Patent Number: 4,750,278

[45] Date of Patent: Jun. 14, 1988

[54] DISPOSABLE SHOE HEEL SHIELD

[76] Inventor: Barbara J. Cates, 2801 Tanglewood, Odessa, Tex. 79762

[21] Appl. No.: 137,643

[22] Filed: Dec. 24, 1987

[51] Int. Cl.[4] ..... A43B 13/22

[52] U.S. Cl. ..... 36/72 B; 36/72 R

[58] Field of Search ..... 36/72 R, 72 B, 73, 71.5; 12/142 K; 428/194, 40, 41, 42

[56] References Cited

U.S. PATENT DOCUMENTS

| | | | |
|---|---|---|---|
| 1,295,022 | 2/1919 | Gifford | 36/9 A |
| 1,955,159 | 4/1934 | Winget | 36/72 |
| 2,915,836 | 12/1959 | McDonough | 36/72 |
| 3,025,617 | 3/1962 | Rizzonelli | 36/72 |
| 3,063,172 | 11/1962 | Beattie | 36/72 |
| 3,270,442 | 9/1966 | Liebmann et al. | 36/72 B |
| 3,851,412 | 12/1974 | Voegele et al. | 36/72 |
| 4,104,816 | 8/1978 | Pingeton | 428/41 |
| 4,379,573 | 4/1983 | Lomeli et al. | 428/42 |
| 4,420,520 | 12/1983 | Jones et al. | 428/42 |
| 4,544,590 | 10/1985 | Egan | 428/41 |
| 4,550,683 | 11/1985 | Jones | 428/42 |
| 4,584,219 | 4/1986 | Baartmans | 428/42 |

FOREIGN PATENT DOCUMENTS

| | | | |
|---|---|---|---|
| 531242 | 9/1954 | Belgium | 36/72 B |
| 604621 | 5/1926 | France | 36/72 B |
| 452479 | 5/1968 | Switzerland | 428/194 |
| 365578 | 5/1930 | United Kingdom | 36/34 B |
| 388973 | 3/1933 | United Kingdom | 36/137 |
| 2171590 | 9/1986 | United Kingdom . | |
| 2188224 | 9/1987 | United Kingdom | 36/72 B |

*Primary Examiner*—Steven N. Meyers

*Attorney, Agent, or Firm*—Marcus L. Bates

[57] ABSTRACT

A disposable shoe heel protector device is removably affixed to the back of a shoe in an area to cover and protect the rearward part of the shoe that makes sliding contact with the floorboard of an automobile while driving. The protector is made in an oblated configuration and therefore has a long and a short dimension. The protector comprises a flexible main support in the form of an eliptical cutout from a sheet of thin flexible plastic material. The support has an inside surface opposed to an outside surface. Adhesive material coats the inside surface at the opposed marginal ends of the support. A cushion in the form of a thin piece of foam material is attached to the medial inside surface of the support and extends from the adhesive on one side to the adhesive on the opposed side, thereby leaving the centrally located foam material which bears against the shoe surface with the adhesive being located at the opposed ends of the support. The adhesive at the marginal ends of the support releasable attaches the protector device to the outer surface of a shoe. A silicon coated wrapper having the same area and dimension as the adhesive coated part of the support protects the adhesive until the protector is needed. The protector can therefore be stored in stacked relationship until needed, and at that time the wrappers are peeled off to expose the adhesive. The protector is affixed to the shoe heel at the opposed marginal ends thereof by pressing the ends bearing the adhesive to the shoe. The protector device subsequently can be removed and discarded by peeling it off the shoe. The adhesive preferably is arranged at the marginal ends of the long dimension of the oblated cutout. Preferably, the adhesive is applied as a thin coating over the entire inside surface of the cutout, fastens the cushion in place, and leaves the opposed coated marginal ends available for attaching the protector to the rear of the shoe.

12 Claims, 1 Drawing Sheet

FIG. 1
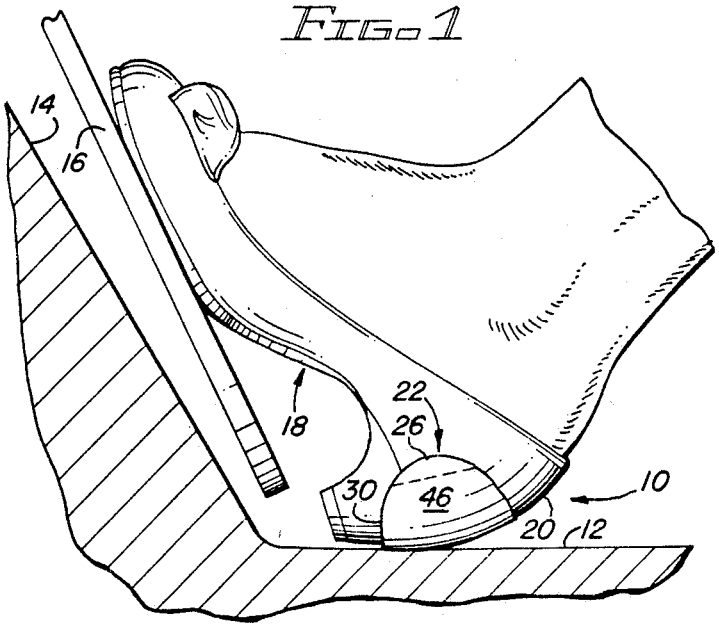
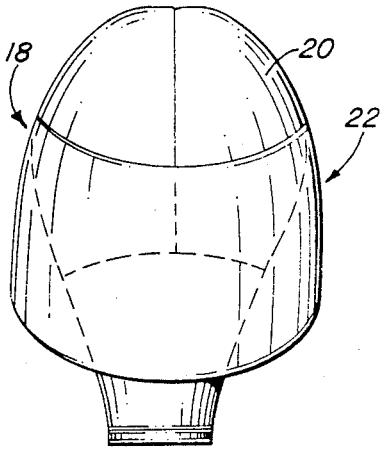
FIG. 2
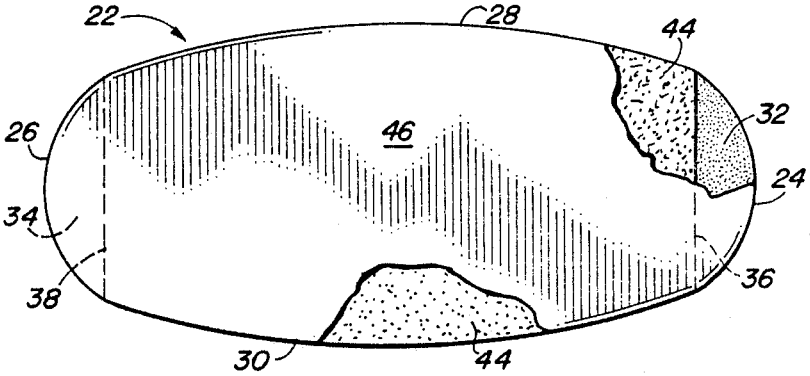
FIG. 3
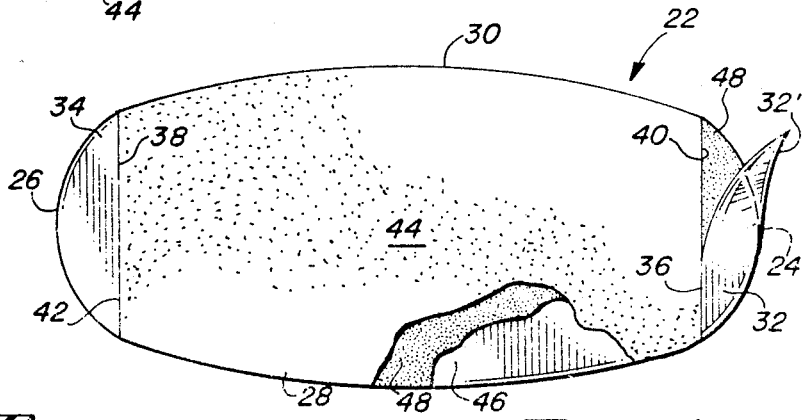
FIG. 4
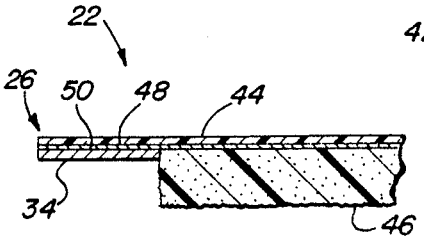
FIG. 6
FIG. 5
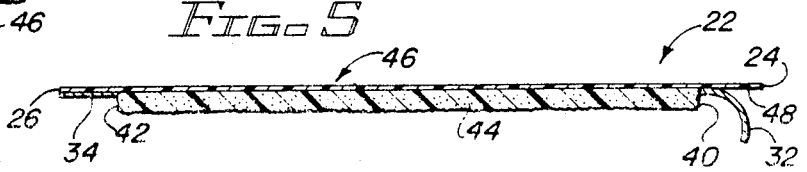

DISPOSABLE SHOE HEEL SHIELD

BACKGROUND OF THE DISCLOSURE

Many people take great pride in their footwear. For example some men purchase shoes or boots worth more than $100.00 a pair and they try to keep the footwear in superb condition. There are many people out west who sincerely believe that it really does not matter what a person wears so long as they have on a good hat and a well polished pair of new boots or shoes.

Girls, especially, are self-conscious about their footwear and take great pains to see that their shoes are well polished and in like-new condition. After all, the shoes amplify and attract the eye to the legs of a woman and most women prefer that the furtive glances generated by the neat appearance of the shoes and legs is found pleasing by her associates.

The prior art illustrates several attempts at protecting the shoe heels of a driver of a vehicle, that is, the rear of the foot wearing apparel that rests on the floorboards of a vehicle. Women's shoes and western boots are easily scuffed while manipulating the controls of a vehicle. This is especially so with the accelerator of an automobile and the rudder pedals of an aircraft. In the first instance, it is necessary to scrub the rear of the shoe against the floorboard as one interchanges the foot from the accelerator to the break pedal, and vice versa.

An airplane with heel type brakes is especially liable to scuff footwear, especially western style boots and ladies shoes, because it is necessary to physically slide the heel of the foot against the floorboard of the aircraft to make certain that the heel is fully positioned against the brake peddle and will not inadvertently come off during landing and take-off especially. There is little feel between the bottom of the heel of a shoe and the brake pedal.

It would therefore be desirable to have made available a disposable heel shield that could be easily and rapidly placed on the rear surface of either shoe in a position which protects the rear of the shoe from being scuffed by the floorboard of a vehicle. It would be desirable that such a shield be low in cost so that it could be used once or a few times and then discarded. It would be desirable for such a shield to be small and flexible to thereby permit several of them to be placed in various strategic locations so that access thereto is more convenient.

SUMMARY OF THE INVENTION

A disposable shoe heel protector device is removably affixed to the back of a shoe in an area to cover and protect the rearward part of the shoe that makes sliding contact with the floorboard of an automobile while driving. The protector is made in an oblated configuration and therefore has a long and a short dimension. The protector comprises a flexible main support in the form of an oblated cutout from a sheet of thin flexible plastic material. The support has an inside surface opposed to an outside surface. Adhesive material coats the inside surface at the opposed marginal ends of the support.

A cushion in the form of a thin layer of foam material is attached to the medial inside surface of the support and extends from the adhesive on one side to the adhesive on the opposed side, thereby leaving a centrally located foam material which bears against the shoe surface with the adhesive being located at the opposed ends of the support. The adhesive at the marginal ends of the support releasable attaches the protector device to the surface of a shoe.

A silicon coated wrapper having the same area and dimension as the adhesive coated part of the support protects the adhesive until the protector is needed. The protector can therefore be stored in stacked relationship until needed, and at that time the wrappers are peeled off to expose the adhesive. The protector is affixed to the shoe heel at the opposed marginal ends thereof by pressing the ends bearing the adhesive to the shoe. The protector device subsequently can be removed and discarded by peeling it off the shoe.

The adhesive preferably is arranged at the marginal ends of the long dimension of the oblated cutout. Preferably, the adhesive is applied as a thin coating over the entire inside surface of the cutout, fastens the cushion in place, and leaves the opposed coated marginal ends available for attaching the protector to the rear of the shoe.

Accordingly, a primary object of the present invention is the provision of a disposable shoe heel protector which can be removably affixed to a shoe heel and after use, can be discarded, if desired.

Another object of the invention is to provide a protector for a shoe heel having a main flexible body, a cushion centrally located on the inside surface of the main body, and adhesive applied to the opposed ends of the inside surface of the main body so that the protector can be removably affixed by the adhesive to the surface of a shoe.

A still further object of this invention is the provision of a shoe protector device that is low in cost, easy to apply, and can be removed easily and discarded when it is no longer needed.

An additional object of the present invention is the provision of a protector device that is removably affixed to the heel of a shoe, having a flexible plastic outer surface, a cushion on the inner surface, with there being opposed marginal ends of the inner surface which are releasable affixed to the outer surface of the shoe by adhesive coating thereon.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

BRIEF DESCRIPTION OF THE DRAWINGS

FIG. 1 is a fragmentary, side elevational view showing the protector device of the present invention operatively attached to a shoe;

FIG. 2 is a rear view of the shoe and protector device seen in FIG. 1;

FIG. 3 is a top plan view of the protector device disclosed in the foregoing figures, with some parts being removed therefrom in order to disclose important details thereof;

FIG. 4 is similar to FIG. 3 and additionally shows the details of an important feature of the invention;

FIG. 5 is a longitudinal cross-sectional view of FIG. 4; and

FIG. 6 is an enlarged, fragmentary, longitudinal, cross-sectional view of part of the apparatus disclosed in the foregoing figures.

DETAILED DESCRIPTION OF THE PREFERRED EMBODIMENT

FIG. 1 discloses the combination 10 of the present invention which comprises a shoe in combination with a removable shield therefor. The shield is positioned at the rear of the shoe and partially covers the heel thereof. The combination is shown resting on the floorboard 12, 14 of an automotive vehicle. The usual foot operated gas pedal is indicated at 16.

Numeral 18 indicates an ordinary shoe having a heel 20 with there being a disposable shoe heel protector 22 interposed between the rear surface of the heel 20 and the shoe 18, and the floorboard 12 of a vehicle, thereby protecting the finish on the rear surface of the shoe. The shoe can take on any number of different forms, and boots are included by this term.

In FIGS. 3 and 4, together with the other figures of the drawings, the protector device 22, made in accordance with the present invention, is of oblated configuration. The device 22 is an ellipse and therefore has a long axis from one portion 24 to end portion 26 and a short axis from side 28 to side 30. Numeral 32 is a crescent shaped paper wrapper, usually treated with a silicon coating, or the like, so that the paper will not adhere permanently to the adhesive, as is known to those skilled in the art. The opposed end 26 has a similar wrapper 34. Numerals 36 and 38 indicate the inner end portion of the wrapper.

Numerals 40, 42 indicate the opposed ends of a cushion 44. The cusion 44 preferably is made of thin foam material, the details of which are more fully discussed later on herein.

Numeral 46 indicates the inner surface of a main support, preferably a thin sheet of flexible material, as for example, plastic. Adhesive 48 coats the inside surface 46 of the plastic member and bonds the cushion 44 to the main support 46. The adhesive 46 extends outwardly from the opposed edges 40, 42 of the cushion 44, thereby providing the opposed marginal ends of the protector device with a coating of adhesive so that the device can be releasable affixed to the surface of a shoe in the manner of FIGS. 1 and 2. Numeral 32' indicates a wrapper that protects the underlying adhesive until the protector device is needed.

In FIG. 5, the wrapper 32 on the right hand side has been partially removed from the adhesive coated or backed main support 46. The wrapper remains in place on the left hand side of the drawing. The cushion 44 is seen to be attached to the main support by the before mentioned adhesive 48.

In the enlarged cross-sectional view seen in FIG. 6, the silicon coated wrapper has silicon 50 coating the wrapper 34 so that the adhesive 44 is not contaminated, and will not attach to the wrapper.

The main support 46 preferably is Scotchcal 3650 (TM) made by 3M Corporation. St. Paul, Minn. The material is 2 mils thick, lasts 5–7 years, is very durable, and is coated on one side with adhesive and can be used outdoors. A wrapper covers the adhesive.

Another material which can be used for the main support is marketed by Flexcon Co. Spenser, Mass. Wall Street, identified as V-400FW, is 4 mils thick, has less adhesive than the above material, and is the preferred material for the main support.

The cushion 44 is available as item #21776-0779 from; Fancy Foam, Craft World, Inc., Windsor, Md. This material is a plastic foam about 1/16 inch thick and is available in sheets. This material has an open cellular structure through which smoke can be blown, for example.

The heel protector 22 of the present invention can be manufactured as follows:

cutouts of the main support 46 are made with a template. The wrapper between edges 38 and 40 is removed, thereby exposing the adhesive material 48 therebetween. Cutouts of the foam material is placed in the illustrated manner of FIGS. 3 and 4. The assembled product is packaged, ready for use.

When it is desired to protect the rear surface of a shoe, including the upper part of the heel, the wrappers 32 are removed from the opposed ends of the main support and the protector device is applied to the heel of the shoe in the manner of FIGS. 1 and 2. The cushion 44 bears against the surface of the shoe and protects the finish thereof from being scuffed by debris lying on the floorboard 12 of a vehicle.

When one arrives at an important gathering, the protector is easily removed by grasping either edge portion 28 or 30 between one's fingers and peeling the protector from the shoe. The protector can be stored on the automobile dash and reused another time if desired. Otherwise, the protector can be discarded, taking care not to litter.

I claim:

1. A disposable shoe heel protector which can be removably affixed to a shoe heel and subsequently discarded; said protector is made in an oblated configuration, there being a long and a short dimension thereof;

said protector comprises a main support in the form of an oblated cut-out made from a sheet of thin, flexible, plastic material; said support has an inside surface opposed to an outside surface; adhesive material coats the inside surface at the opposed marginal ends of said support;

a cushion in the form of a thin layer of foam material attached to the medial inside surface of said support, said foam material extends from the adhesive on one side to the adhesive on the opposed side, said foam material and said adhesive jointly cover the entire inner surface area of the support;

a silicon coated wrapper of the same area and dimensions of the support covering the entire side of the protector which is opposed to the outside thereof; whereby;

said protector can be stored until needed, the wrapper pealed off the inside side of the protector, whereupon the protector is affixed to the shoe heel, and subsequently removed.

2. The protector of claim 1 wherein the adhesive is arranged at the marginal ends of the long dimension of said oblated cut-out.

3. The protector of claim 2 wherein there is a thin coating of adhesive on the entire inside surface of the cut-out that fastens the cushions in place and further releasable attaches the protector to the shoe heel.

4. The protector of claim 3 wherein said cut-out is about 0.004 inches thick, said cushion is about 1/16 inches thick.

5. A disposable shoe heel protector for shielding the rear of a shoe, said protector can be removably affixed to an upper part of a shoe heel and subsequently discarded after being used; said protector is made in an oblated configuration, there being a long axis and a short axis of the protector that forms a long and a short dimension thereof;

said protector includes a main support in the form of an oblated cut-out from a sheet of thin, flexible, self-supporting material; said support has an inside surface opposed to an outside surface; adhesive material on the inside surface at the opposed marginal ends of said support;

a cushion made of a thin layer of soft sponge-like material attached to the medial inside surface of said support, said cushion extends from the adhesive on one side to the adhesive on the opposed side, said cushion and said adhesive jointly cover the entire inner surface area of the support;

a wrapper of the same area and dimensions of the marginal ends of the support which covers the exposed adhesive on the side of the protector which is opposed to the outside thereof, thereby protecting the adhesive until the protector is used, whereby;

said protector can be stored until needed, the wrapper pealed off the inside side of the protector, whereupon the protector can then be affixed to the rear of the shoe and heel by the adhesive and thereby protects the covered surface of the shoe from damage, and can be subsequently removed and discarded.

6. The protector of claim 5 wherein the adhesive is arranged at the marginal ends of the long dimension of said oblated cut-out, said adhesive covers less than 20% of the area of the inside surface of the support.

7. The protector of claim 6 wherein there is a thin coating of adhesive on the entire inside surface of the cut-out that fastens the cushion in place and leaves exposed adhesive on opposed sides thereby releasable attaching the protector to the rear of the shoe and heel.

8. The protector of claim 7 wherein said cut-out is about 0.004 inches thick, and said cushion is about 1/16 inches thick.

9. A disposable shoe heel protector in combination with a shoe, said protector can be removably affixed to the rear of a shoe heel and subsequently discarded; said protector is made in an eliptical configuration, there being a long and a short dimension thereof;

said protector comprises a main support in the form of an eliptical cut-out made from a sheet of thin, flexible, plastic material; said support has an inside surface opposed to an outside surface; a coating of adhesive material on the inside surface at the opposed marginal ends of said support;

a cushion in the form of a thin layer of foam material attached to the medial inside surface of said support, said foam material extends from the adhesive on one side to the adhesive on the opposed side, said foam material and said adhesive jointly cover the entire inner surface area of the support;

the adhesive is arranged at the marginal ends of the long dimension of said eliptical cut-out; a thin coating of adhesive on the entire inside surface of the cut-out that fastens the cushion in place and further releasable attaches the protector to the rear of the shoe and heel; said cut-out is about 0.004 inches thick, and said cushion is about 1/16 inches thick;

a crescent shape silicon coated wrapper of the same area and dimensions of the exposed adhesive that coats the support for covering the opposed marginal ends of the protector; whereby;

said protector can be stored until needed, the wrappers pealed off the inside side of the protector, whereupon the protector is then affixed to the rear of the shoe and heel, and subsequently removed after use.

10. The protector of claim 9 wherein the adhesive is arranged at the marginal ends of the long dimension of said oblated cut-out, whereby only the adhesive and the cushion bear against the outer surface of the shoe.

11. The protector of claim 10 wherein there is a thin coating of adhesive on the entire inside surface of the cut-out that fastens the cushion in place and further releasable attaches the protector to the shoe heel.

12. The protector of claim 11 wherein said cut-out is about five inches long and two inches wide, and said cushion is about four inches long and about as wide as the cut-out.

* * * * *